US011608598B2

(12) United States Patent
Seyrlehner

(10) Patent No.: US 11,608,598 B2
(45) Date of Patent: Mar. 21, 2023

(54) TAMPING ASSEMBLY FOR TAMPING SLEEPERS OF A TRACK

(71) Applicant: Plasser & Theurer Export von Bahnbaumaschinen GmbH, Vienna (AT)

(72) Inventor: Georg Seyrlehner, Chesapeake, VA (US)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 485 days.

(21) Appl. No.: 16/625,923

(22) PCT Filed: Jul. 9, 2018

(86) PCT No.: PCT/EP2018/068484
§ 371 (c)(1),
(2) Date: Dec. 23, 2019

(87) PCT Pub. No.: WO2019/029923
PCT Pub. Date: Feb. 14, 2019

(65) Prior Publication Data

US 2020/0157745 A1 May 21, 2020

(30) Foreign Application Priority Data

Aug. 8, 2017 (AT) ..... A 325/2017

(51) Int. Cl.
*E01B 27/16* (2006.01)

(52) U.S. Cl.
CPC ..... *E01B 27/16* (2013.01); *E01B 2203/12* (2013.01)

(58) Field of Classification Search
CPC ..... E01B 27/16; E01B 27/17; E01B 27/20; E01B 35/00; E01B 25/02; E01B 35/04;
(Continued)

(56) References Cited

U.S. PATENT DOCUMENTS 3,608,498 A * 9/1971 Plasser ..... E01B 27/16 104/12
4,094,251 A * 6/1978 Theurer ..... E01B 27/17 104/12

(Continued)

FOREIGN PATENT DOCUMENTS

AT 294895 B 12/1971
AT 313957 B 3/1974

(Continued)

OTHER PUBLICATIONS

Chinese Office Action in Chinese Patent Application No. 201880048897.1 dated Apr. 21, 2021 with English translation.

(Continued)

*Primary Examiner* — Zachary L Kuhfuss
*Assistant Examiner* — Cheng Lin
(74) *Attorney, Agent, or Firm* — Collard & Roe, P.C.

(57) ABSTRACT

The invention relates to a tamping assembly for tamping sleepers of a track, comprising a tamping unit having oppositely positioned tamping tools which are mounted on a lowerable tool carrier and connected in each case to a squeezing drive for generating a squeezing motion, wherein an eccentric drive having an eccentric shaft is provided for generating a vibratory motion. In this, it is provided that each squeezing drive is supported on a console having a ring-shaped housing section which is mounted on an eccentric section, associated with the squeezing drive, of the eccentric shaft.

9 Claims, 3 Drawing Sheets

(58) Field of Classification Search
CPC .. E01B 35/10; E01B 2203/10; E01B 2203/12; E01B 2203/122; E01B 2203/127; E01B 29/00; E01B 29/16; E01B 29/20
See application file for complete search history.

(56) References Cited

U.S. PATENT DOCUMENTS

| | | | | |
|---|---|---|---|---|
| 4,218,978 | A * | 8/1980 | Pasquini | E01B 27/16 104/10 |
| 4,240,352 | A * | 12/1980 | Theurer | E01B 27/16 104/12 |
| 4,332,200 | A * | 6/1982 | Ganz | E01B 27/16 184/6.12 |
| 5,133,263 | A | 7/1992 | Theurer | |
| 5,533,455 | A | 7/1996 | Theurer et al. | |
| 6,386,114 | B1 * | 5/2002 | Morgan | E01B 27/16 104/14 |
| 9,731,324 | B2 * | 8/2017 | Pritzl | B06B 1/16 |
| 10,100,469 | B2 * | 10/2018 | Lichtberger | E01B 27/16 |
| 10,563,358 | B2 * | 2/2020 | Hoefler | E01B 27/16 |
| 10,808,362 | B2 * | 10/2020 | Seyrlehner | B06B 1/164 |
| 2015/0267355 | A1 | 9/2015 | Hofstaetter | |
| 2018/0010302 | A1 * | 1/2018 | Padovani | F04B 49/065 |

FOREIGN PATENT DOCUMENTS

| | | | |
|---|---|---|---|
| AT | 350097 | B | 5/1979 |
| CN | 1125281 | A | 6/1996 |
| CN | 2545248 | Y | 4/2003 |
| CN | 201148582 | Y | 11/2008 |
| CN | 105421169 | A | 3/2016 |
| DE | 2610519 | A1 | 12/1976 |
| DE | 2806898 | A1 | 8/1978 |
| DE | 41 12 224 | A1 | 10/1991 |
| JP | S53119507 | A | 10/1978 |
| JP | 2015-532374 | A | 11/2015 |

OTHER PUBLICATIONS

International Search Report of PCT/EP2018/068484, dated Oct. 5, 2018.
Chinese Office Action in Chinese Patent Application No. 201880048897.1 dated Apr. 21, 2021.
Austrian Search Report in Austrian Application No. A 325/2017 dated Mar. 8, 2018.

* cited by examiner

TAMPING ASSEMBLY FOR TAMPING SLEEPERS OF A TRACK

CROSS REFERENCE TO RELATED APPLICATIONS

This application is the National Stage of PCT/EP2018/068484 filed on Jul. 9, 2018, which claims priority under 35 U.S.C. § 119 of Austrian Application No. A 325/2017 filed on Aug. 8, 2017, the disclosures of which are incorporated by reference. The international application under PCT article 21(2) was not published in English.

FIELD OF TECHNOLOGY

The invention relates to a tamping assembly for tamping sleepers of a track, comprising a tamping unit having oppositely positioned tamping tools which are mounted on a lowerable tool carrier and connected in each case to a squeezing drive for generating a squeezing motion, wherein an eccentric drive having an eccentric shaft is provided for generating a vibratory motion.

PRIOR ART

For maintenance of a track or after a track renewal it is usually necessary to compact a ballast bed. Besides hand tampers, tamping assemblies arranged on track maintenance machines are known for this purpose. During a track tamping operation, the track maintenance machine moves along the track, while tamping tines fastened to the tamping assembly are lowered into sleeper cribs and squeezed together.

During this, a tamping assembly is subjected to extremely high stress. Particularly during the process of immersion into the ballast bed and during the subsequent compaction of the ballast underneath a sleeper, extreme load changes occur constantly which severely stress the vibration drive. Even between the tamping procedures, the tamping assembly can be seriously stressed by a constantly operating vibration drive and the vibration transmitted to the tamping tools.

Tamping assemblies for tamping sleepers of a track are already well known, such as, for example, from AT 350 097 B. Serving as a vibration generator is a rotatable eccentric shaft to which the squeezing drives are articulatedly connected for transmitting the vibrations to the tamping tines.

SUMMARY OF THE INVENTION

It is the object of the invention to provide an improvement over the prior art for a tamping assembly of the kind mentioned at the beginning.

According to the invention, this object is achieved by way of a tamping assembly according to claim 1. Dependent claims show advantageous embodiments of the invention.

The invention provides that each squeezing drive is supported on a console having a ring-shaped housing section which is mounted on an eccentric section, associated with the squeezing drive, of the eccentric shaft. In this manner, the tamping assembly is designed to have a particularly slim and compact structure. Due to the arrangement of the consoles, the squeezing drive and eccentric shaft are arranged in a space-saving way underneath one another.

A simple embodiment of the invention provides that the housing section in each case is mounted on the associated eccentric section by means of a roller bearing. Roller bearings are maintenance-free for the entire service life. Due to small friction moments and also little warming, no additional installations—such as oil cooling, for example—are required at normal rotation speeds.

It is advantageous, however, if a pneumatic oil lubrication for the roller bearing of the respective housing section is provided on the associated eccentric section. Such a continuous lubrication with very small oil volumes causes an optimization of the service life of the roller bearing. Because of the minimal oil requirement, even a small oil container is sufficient to ensure a long interruption-free operating time. Such an oil container can be arranged in immediate proximity to the eccentric drive.

Preferably, the console in each case is designed P-shaped, having a support section pointing downward. This design of the respective console enables a structurally simple and space-saving solution for arranging the squeezing drives.

In an advantageous improved design, the respective squeezing drive is supported with one end on the associated console and connected at a further point to the housing section of the console. As a result of the additional support of the squeezing drive on the console, an improved stress distribution and force transmission exists. The individual components can then be optimally dimensioned and thus made light-weight.

In this, it is advantageous if the respective squeezing drive is connected at the further point to the housing section of the associated console by means of a bell-shaped connecting element. Thus, a structurally simple and inexpensive possibility exists to anchor the squeezing drive safely on the console.

An advantageous further development provides that the two squeezing drives are arranged next to one another underneath the eccentric drive and oriented oppositely. Due to this arrangement, the individual tamping modules of the tamping assembly are configured in the most space-saving and compact way.

Advantageously, the respective tamping tool is connected by means of an offset lever arm to the associated squeezing drive. With this structurally simple solution, it is accomplished that the oppositely positioned tamping tools have a common line of action even though the associated squeezing drives are arranged laterally offset to one another.

It is further advantageous if the squeezing drive is designed in each case as a hydraulic cylinder. The asynchronous pressure-dependent squeezing of the tamping tines thus achieved causes a uniform compaction under all sleepers of a track to be tamped. In addition, by means of the hydraulic cylinders, great forces can be applied with small structural size.

A further advantageous embodiment of the invention provides that the tamping assembly comprises several structurally identical tamping units for simultaneously tamping several sleepers. Here, the slim design is of particular advantage. As a result of this flexible design and variable combination of tamping units, the tamping assemblies are matched perfectly to the conditions in operation and to customer demands. Additionally, the modular design enables an economic and efficient manufacturing.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
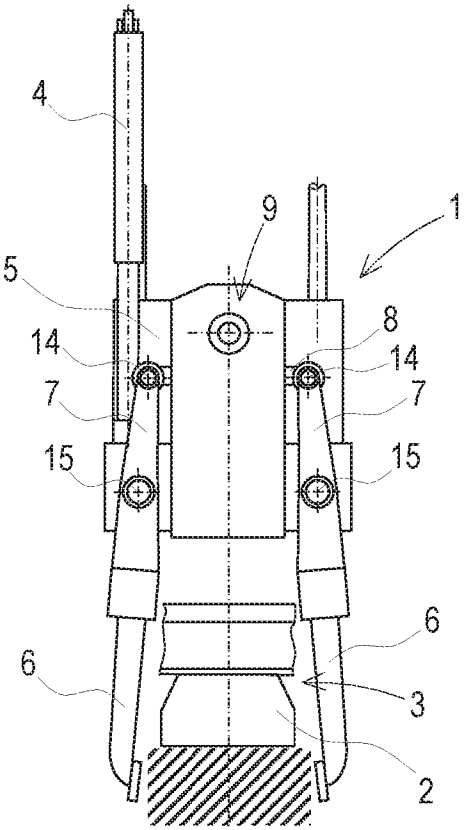
FIG. 1 a lowered tamping unit

FIG. 1 shows a simplified representation of a tamping unit 1 for tamping sleepers 2 of a track 3, having a tool carrier 5, lowerable by a drive 4, and pairs of two oppositely positioned tamping tools 6. Each tamping tool 6 is connected via a pivot arm 7 and a squeezing drive 8 to an eccentric drive 9. The squeezing drive 8 is supported in each case on a console 10 which has a ring-shaped housing section 11 mounted on a respective eccentric section 12, associated with the squeezing drive 8, of an eccentric shaft 13 of the eccentric drive 9. The respective pivot arm 7 has an upper pivot axis 14 on which the squeezing drive 8 is mounted. The respective pivot arm 7 is supported on the tool carrier 5 for rotation about a lower pivot axis 15. Such a tamping unit 1 is intended for installation into a tamping assembly 16 in a track tamping machine mobile on the track 3, or into a tamping satellite.

Figure 2:
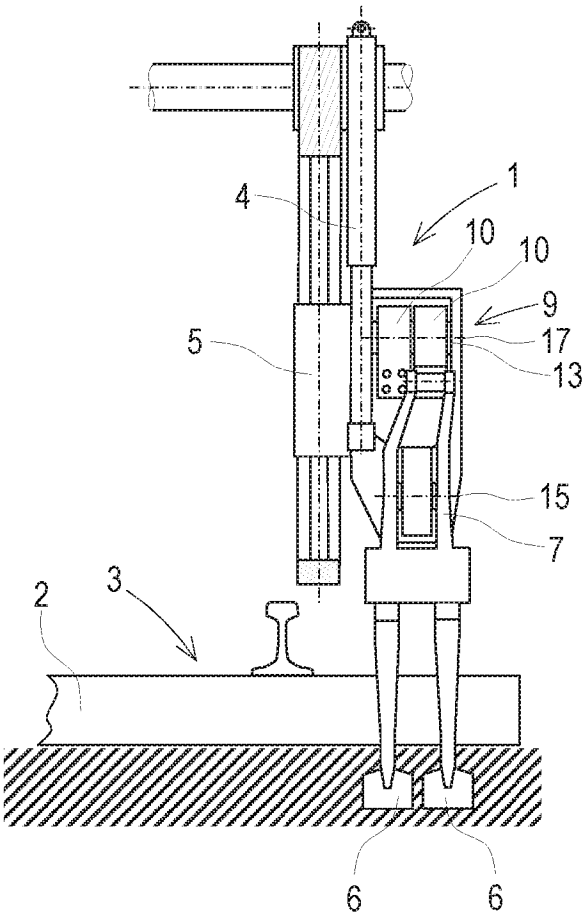
FIG. 2 a lowered tamping unit in side view

Shown in FIG. 2 is a side view of the tamping unit 1, wherein the same is also in a lowered position. The eccentric drive 9 including the two consoles 10 is arranged on an eccentric axis 17 within the tool carrier 5. The eccentric shaft 13 is rotatably supported at both sides within the tool carrier 5 via a support 18. The respective pivot arm 7 is designed as an offset lever arm, so that the tamping tools 6 are aligned exactly oppositely in spite of the eccentric sections 12 being arranged side by side.

In general, it becomes possible only by use of the consoles 10 to build the tamping units 1 and thus the combined tamping assemblies 16 in a particularly slim way regarding their dimensions, since the squeezing drives 8 are arranged directly below the eccentric shaft 13.

Figure 3:
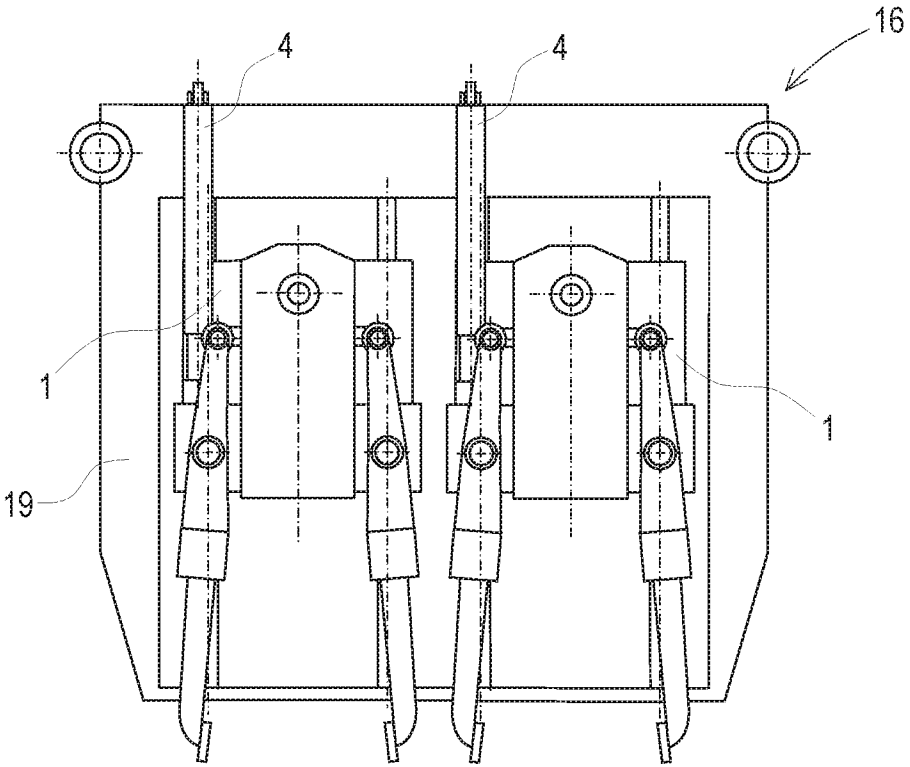
FIG. 3 a tamping assembly in modular design

FIG. 3 shows two tamping units 1 arranged in an assembly frame 19 and combined into a tamping assembly 16. In this manner, it is possible to realize multi-sleeper tamping assemblies simply and flexibly by the combination of several tamping units 1 in modular design. Each modular unit has a separate drive 4 mounted on the assembly frame 19, so that it can be lowered individually into a ballast bed, as required.

Figure 4:
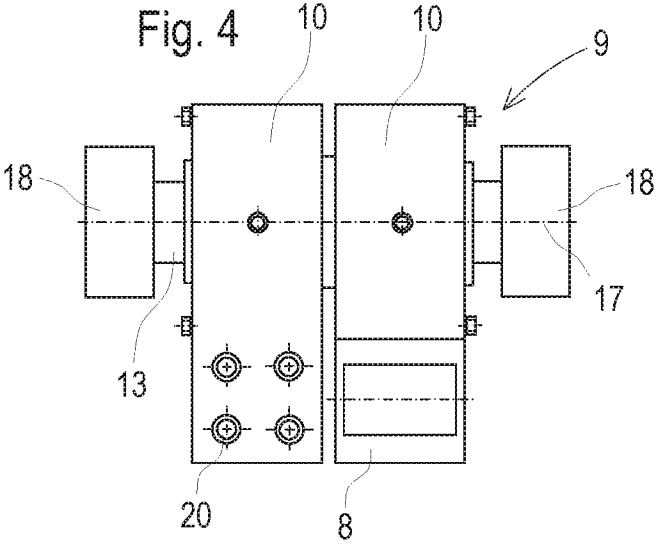
FIG. 4 a detail view of eccentric drive with consoles
FIG. 5 a detail view of eccentric drive with consoles
FIG. 6 a detail sectional view of eccentric drive
FIG. 7 a detail sectional view of squeezing drive

FIG. 4 shows a detail view of the eccentric drive 9 including an eccentric shaft 13 and support 18 arranged at both sides. The eccentric shaft 13 has two eccentric sections 12 with two oppositely acting eccentrics. The console 10 is arranged on the respective eccentric section 12. The associated squeezing drive 8 is fastened by means of screw connections 20 to the respective console.

Figure 5:
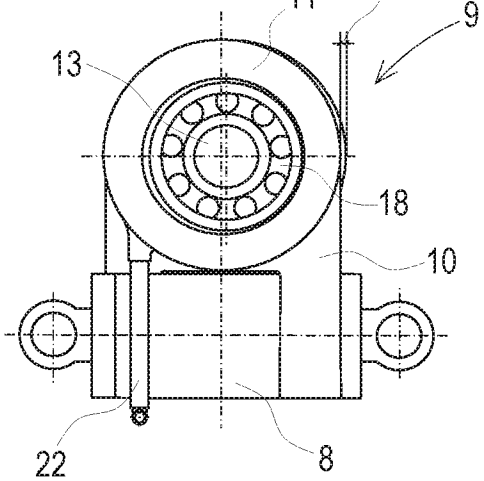

Shown in FIG. 5 is a detail side view of the eccentric drive 9 including consoles 10 and squeezing drives 8. Due to the oppositely acting eccentrics, the two consoles 10 including ring-shaped housing sections 11 have an offset 21. Furthermore, because of the great stress in operation, it is useful to connect the squeezing drive 8 to the console 10 by a further fastening in addition to the screw connections 20. By way of example, this fastening is realized here by means of a bell-shaped connecting element 22.

Figure 6:
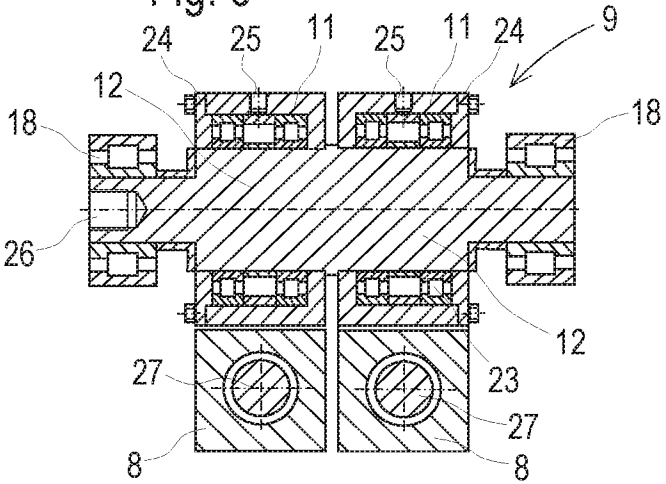

FIG. 6 shows the eccentric drive 9 in a sectional view. A roller bearing 23 is arranged on the respective eccentric section 12 in the circular housing section 11 of the consoles 10. At the outside, the housing section 11 has a screwed housing cover 24 in each case. Pneumatic oil lubrication is provided as lubrication. In this, a small excess air pressure is generated in the closed housing section 11, and every 5-6 minutes a drop of oil is added via an oil bore 25. At one end of the eccentric shaft 13, an inner tooth system 26 is provided for force-locking connection to a drive motor. The latter can be designed hydraulically or electrically, as desired.

Figure 7:
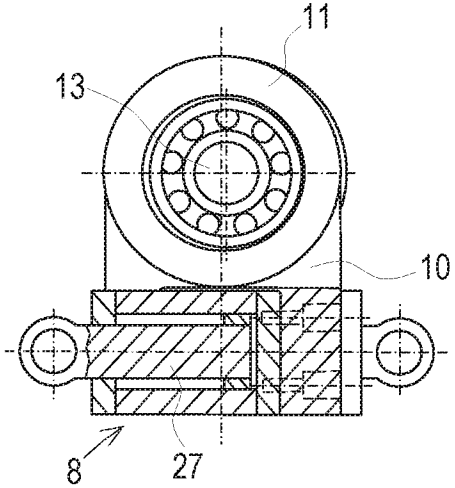

FIG. 7 shows a section through the squeezing drive 8 arranged on the console 10. Said squeezing drive 8 has a piston rod 27 to press the respective pivot arm 7 outward. In this manner, a squeezing motion is superimposed on the vibration generated by means of the eccentric drive 9.

The invention claimed is:

1. A tamping assembly for tamping sleepers of a track, comprising:

a tamping unit;

a lowerable tool carrier;

oppositely positioned tamping tools which are mounted on the lowerable tool carrier;

a squeezing drive coupled to each of said tamping tools, said squeezing drive for generating a squeezing motion, wherein each squeezing drive is arranged next to each other;

an eccentric drive having an eccentric shaft having an eccentric section, wherein said eccentric drive is provided for generating a vibratory motion, and wherein each squeezing drive is arranged directly below said eccentric section of said eccentric shaft; and a console, wherein each squeezing drive is supported on said console wherein said console has a ring-shaped housing section which is mounted on said eccentric section, associated with the squeezing drive, of the eccentric shaft;

wherein the console in each case is designed P-shaped, having a support section pointing downward.

2. The tamping assembly according to claim 1, wherein the housing section in each case is mounted on the associated eccentric section by means of a roller bearing.

3. The tamping assembly according to claim 2, wherein a pneumatic oil lubrication for the roller bearing of the respective housing section is provided on the associated eccentric section.

4. The tamping assembly according to claim 1, wherein the respective squeezing drive is supported with one end on the associated console and connected at a further point to the housing section of the console.

5. The tamping assembly according to claim 4, wherein the respective squeezing drive is connected at the further point to the housing section of the associated console by means of a bell-shaped connecting element.

6. The tamping assembly according to claim 1, wherein the two squeezing drives are arranged next to one another underneath the eccentric drive and oriented oppositely.

7. The tamping assembly according to claim 6, wherein the respective tamping tool is connected by means of an offset lever arm to the associated squeezing drive.

8. The tamping assembly according to claim 1, wherein the squeezing drive is designed in each case as a hydraulic cylinder.

9. The tamping assembly according to claim 1, wherein the tamping assembly comprises several structurally identical tamping units for simultaneously tamping several sleepers.

* * * * *